United States Patent [19]

Svrjcek, Jr.

[11] 4,084,511

[45] Apr. 18, 1978

[54] ELECTROLYTIC TIMING ELEMENT

[75] Inventor: Benjamin W. Svrjcek, Jr., Baltimore, Md.

[73] Assignee: The United States of America as represented by the Secretary of the Navy, Washington, D.C.

[21] Appl. No.: 34,598

[22] Filed: Jun. 7, 1960

[51] Int. Cl.[2] ..... F42B 5/08

[52] U.S. Cl. ..... 102/70.2 GA; 307/119; 361/435

[58] Field of Search ..... 307/92, 95, 116, 118, 307/119; 200/61.08; 317/232; 102/82, 70.2

[56] References Cited

U.S. PATENT DOCUMENTS

| | | | |
|---|---|---|---|
| 406,354 | 7/1889 | Kookogey | 307/119 |
| 439,390 | 10/1890 | Edison | 307/119 |
| 2,741,182 | 4/1956 | Faust et al. | 102/82 |

*Primary Examiner*—Nelson Moskowitz
*Attorney, Agent, or Firm*—R. S. Sciascia; A. L. Branning

EXEMPLARY CLAIM

1. An electro-chemical interval timing device comprising a casing, an electrolyte within said casing, a cap sealing said casing, a lead cathode carried by said cap and extending into said casing contained electrolyte at one end and extending beyond said cap outwardly of said casing at the other end, a plurality of silver anodes, means for mounting said anodes in said cap to provide outside connection posts for one end of each of said anodes, the other end of each anode being formed with a rounded head of exact predetermined size and shape, said head extending into said electrolyte, a plurality of cups carried by said caps respectively, each cup partially housing one of said anodes, a plurality of spring biased plugs, each of said plugs being partially housed by one of said cups and connected to one of said anodes, means retaining each of said anodes to their attached plug, a plurality of battery energized circuits each connected to said cathode and to one of said anodes, a variable resistance in each of said circuits, means initiating said battery energized circuits, a second plurality of circuits, each of said second circuits including an open switch positioned adjacent one of said spring biased plugs whereby the energization of said battery energized circuits will cause current to pass through the electrolyte and dissolve the heads of said anodes at an equal rate, said plugs and their attached anodes being released by the dissolving of said anode heads in accordance with their different sizes and shapes.

4 Claims, 3 Drawing Figures

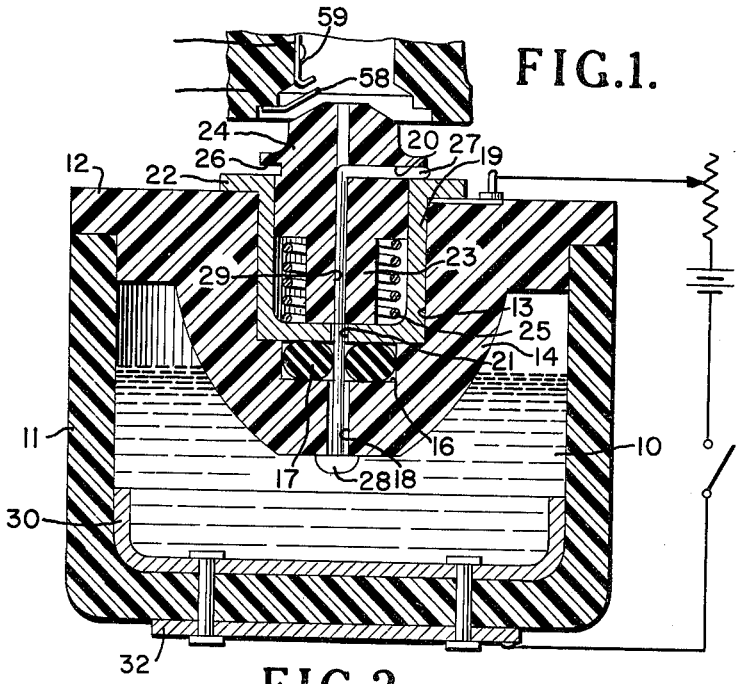
FIG.1.
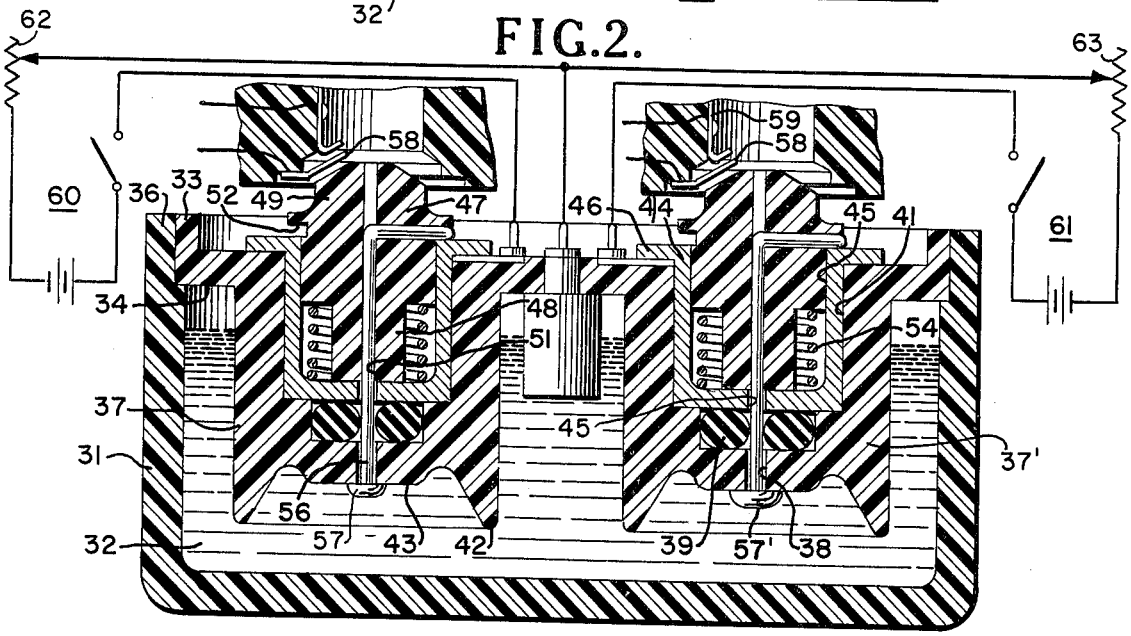
FIG.2.
FIG.3.
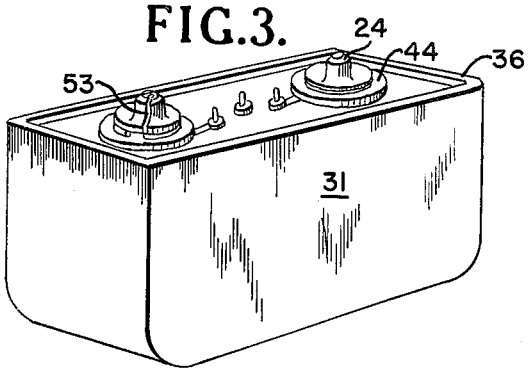

ELECTROLYTIC TIMING ELEMENT

The invention described herein may be manufactured and used by or for the government of the United States of America for governmental purposes without the payment of any royalties thereon or therefor.

This invention relates to an electro-chemical interval timing device in the nature of a battery having a predetermined amount of consumable anode.

An object of this invention is to provide a timing device having a cathode, an anode and an electrolyte and adapted to be included in a battery operated resistance circuit and whose timing interval would be dependent on the current in the circuit and the amount of anode to be consumed.

Another object of the invention is to provide a structural configuration which reduces the possibility of short circuits caused by sludge formations.

Still another object is the provision of a protecting sheath around the anode to prevent short circuits being formed between the anode and the cathode.

A further object of the invention is to provide a structure which would permit the use of a single cathode with any number of differently sized anodes and which provides a timing circuit for each anode.

A still further object of the invention is to provide a multiple interval timer having a cathode and a plurality of consumable anodes, the interval being determined by the rate of consumption of the anodes, with battery energized circuits for each anode with the common cathode and a variable resistance in each circuit which will determine the rate of consumption of each anode.

Other objects and many of the attendant advantages of this invention will be readily appreciated as the same becomes better understood by reference to the following detailed description when considered in connection with the accompanying drawing wherein:

FIG. 1 is a vertical cross-section of the timing device with a single anode;

FIG. 2 is a vertical cross-section of the timing device with plural anodes; and

FIG. 3 is a perspective view of the device of FIG. 2.

Referring to the drawing wherein like parts in the different views are referred to by the same number, a timing device having a single anode is illustrated in FIG. 1. The timing device is made up of a plastic casing 11 cylindrical in cross-section, fitted with a plastic cap 12 and containing electrolyte 10. The cap 12 is secured to the casing by adhesives, heat sealing or in some other suitable manner that will provide a tight sealing relationship and is formed with a central well 13 and an integral depending substantially frusto-conical central section 14.

The central well 13 extends into the frusto-conical section and is of less diameter at the bottom to form a lower compartment 16 which houses a sealing ring 17. Extending from the lower compartment 16 the section 14 is centrally bored as at 18.

Seated in the well and bearing on the sealing ring is a brass cup 19 having a central hole 21 and a flat peripheral rim 22. A plastic plug 23 is formed with a knob-like top 24 having an annular groove 26 and a communicating slot 20. A coil spring 25 seated in the cup 19 bears against the under side of the top 24 to urge the plug outward.

A silver wire anode 27 formed with a head 28 extends up through the bore 18, through the hole 21 and through a bore 29 in the plug. The bore 29 communicates with the groove 26 through the slot 20 and the wire 27 is wrapped around the groove to secure it and bring it into contact with the rim 22 of the cup.

Seated in the housing, a cathode cup 30 is connected to a metal plate 32 by rivets 33 to provide external electrical connecting means. The cathode is formed of lead plated brass while the electrolyte is lead fluoborate. The anode is silver and, when current is passed through the electrolyte, lead is deposited on the cathode and the silver is dissolved and a spongy mass is formed near the cathode which is free to move about in the electrolyte and sometimes shorts the operation.

The timer is utilized in arming mines at some time interval, after they are deposited in the water. The interval can be adjusted from approximately 1 minute to 90 days. This interval is determined by the rate of consumption of the anode and the expired time is governed by the size and shape of the head 28 of the anode. The larger the head the longer the time interval when the current is constant. The time interval may also be regulated by varying the resistance in the battery energized circuit set forth in detail hereinafter.

The head 28 of the anode is carefully designed and the amount of silver necessary to dissolve is carefully determined. The capacity of the battery is known and the resistance is set to determine the rate of output. The silver will dissolve in proportion to the current passing through the electrolyte. When the head of the anode dissolves sufficiently to pass through the bore 18, the spring 25 expels the plug 23 into engagement with contact 58 which makes electrical connection with contact 59 in a normally open circuit and arms the mine.

Referring to FIG. 2 which is the preferred form of the electro-chemical interval timer, a plastic casing 31 holds an electrolyte 10 [lead fluoborate] and supports a cap 33 which rests on a shoulder 34 and is sealed by an adhesive or by heating a rim 36 of the casing sufficiently to make a sealed unit.

Suspended from and integral with the cap are a plurality of cylindrical sections 37 and 37' each of which is identical to each other except for the size of anode heads 57 and 57'. Each section has a central bore 38, a sealing compartment housing a sealing ring 39 and a well 41 concentric with the bore 37. The cylindrical section is formed with an annular apron 42 and a land 43, centrally located with respect to the apron 42.

A brass cup 44 is seated in the well 41 and is formed with a central hole 45 aligning with the bore 38 and also formed with a peripheral rim 46. Carried in the cup 44 is a cylindrical plug 47 having a reduced lower portion 48 and a knob-like top 49. The plug has a central bore 51 adapted to align with bore 38 and the hole 45 of the brass cup and the head portion is formed with an annular groove 52 and a slot 53 connecting the groove 52 with the bore 51. A coil spring 54 seated within the brass cup encircles the reduced portion of the plug and bearing on the botton of the cup and underside of the head of the plug urges the plug in a direction away from the cup.

A silver anode wire 56 extends through the bore 38, the hole 45 of the cup, and the bore 51 of the plug. The end of the wire is fed through the slot 53 and secured in the groove 52 where it is in contact with the rim 46 of the cup. In section 37, the silver anode is formed with a rounded head 57 which is carefully determined as to size and shape and which abuts the central land 43 located within the apron 42 and serves to retain the anode and prevent the coil spring from moving the top of the plug into engagement with the contact 58' to move said contact to circuit closing position with contact 59'. This will complete the circuit 60 to initiate the arming by energizing the electronic units.

As pointed out hereinbefore, section 37' is identical to section 37 except that section 37' has a larger head 61 on the silver anode and can be timed, because of the larger head, to have an interval somewhat longer than its companion timer and can operate a second circuit 62 through contacts 58'', 59'' which will complete the arming of the mine, after allowing sufficient time for all electronic elements to become operative.

The interval timer may be also regulated by varying the current passing through the battery energized circuits by regulating the separate resistances 62, 63 in the different circuits since the consumption of the anode is dependent on the current passing through that anode.

The timer thus far described may be used in various operations requiring an arming mechanism and can control a plurality of normally open circuits, closing the circuits at any predetermined intervals.

Obviously many modifications and variations of the present invention are possible in the light of the above teachings. It is therefore to be understood, that within the scope of the appended claims, the invention may be practiced otherwise than as specifically described.

What is claimed and desired to be secured by Letters Patent of the United States is:

1. An electro-chemical interval timing device comprising a casing, an electrolyte within said casing, a cap sealing said casing, a lead cathode carried by said cap and extending into said casing contained electrolyte at one end and extending beyond said cap outwardly of said casing at the other end, a plurality of silver anodes, means for mounting said anodes in said cap to provide outside connection posts for one end of each of said anodes, the other end of each anode being formed with a rounded head of exact predetermined size and shape, said head extending into said electrolyte, a plurality of cups carried by said caps respectively, each cup partially housing one of said anodes, a plurality of spring biased plugs, each of said plugs being partially housed by one of said cups and connected to one of said anodes, means retaining each of said anodes to their attached plug, a plurality of battery energized circuits each connected to said cathode and to one of said anodes, a variable resistance in each of said circuits, means initiating said battery energized circuits, a second plurality of circuits, each of said second circuits including an open switch positioned adjacent one of said spring biased plugs whereby the energization of said battery energized circuits will cause current to pass through the electrolyte and dissolve the heads of said anodes at an equal rate, said plugs and their attached anodes being released by the dissolving of said anode heads in accordance with their different sizes and shapes.

2. An electro-chemical device comprising; a casing, a cathode carried within said casing and having a connection extending through said casing, an electrolyte within said casing in contact with said cathode, an anode in said casing partially in contact with said electrolyte, resilient means urging said anode in a first direction, said anode having a portion of increased diameter said portion being in contact with said electrolyte, abutment means in abutting contact with said enlarged portion retaining said anode in a first position, a battery energized open circuit connected to said cathode and said anode, means for closing said circuit whereby, when said circuit is closed, said enlarged portion undergoes electro-chemical decomposition whereupon, said anode is releaded from abutting contact with said abutment means and is moved to a second position by said resilient means.

3. An electro-chemical timing device according to claim 2 wherein said abutment means comprises a partition member having an aperture therein, said anode having a portion of reduced diameter less than the diameter of said aperture and said enlarged portion has a diameter greater than said aperture.

4. An electro-chemical timing device comprising; a casing, an electrolyte within said casing, a cathode having a first portion thereof in contact with said electrolyte having a second portion extending through said casing, said casing further including a plurality of cup-shaped members extending into said electrolyte, each of said cup-shaped members having an aperture through the bottom portion thereof, each of said cup-shaped members having a spring biased plug therein, each of said plugs having a central bore therethrough, each of said bores having an anode therein, each of said anodes having a portion extending through one of said apertures, each of said anodes having an enlarged portion of a diameter greater than said aperture, whereby, upon electro-chemical decomposition of said enlarged portions of said anodes, said anodes and said containing plugs are moved due to the force exerted by said resilient means.

* * * * *